US007150573B2

(12) United States Patent
Cummins et al.

(10) Patent No.: US 7,150,573 B2
(45) Date of Patent: Dec. 19, 2006

(54) LABEL PRINTER WITH LABEL SUPPLY FEED CONTROL

(75) Inventors: Robert Cummins, Deephaven, MN (US); Todd Britz, Maple Grove, MN (US); Michael Tolrud, Chaska, MN (US)

(73) Assignee: Primera Technology, Inc., Plymouth, MN (US)

( * ) Notice: Subject to any disclaimer, the term of this patent is extended or adjusted under 35 U.S.C. 154(b) by 0 days.

(21) Appl. No.: 11/251,735

(22) Filed: Oct. 17, 2005

(65) Prior Publication Data

US 2006/0055760 A1 Mar. 16, 2006

Related U.S. Application Data

(63) Continuation-in-part of application No. 10/938,090, filed on Sep. 10, 2004, now abandoned.

(51) Int. Cl.
*B41J 15/04* (2006.01)
*B41J 11/66* (2006.01)
*B41J 11/70* (2006.01)

(52) U.S. Cl. ..... 400/613; 400/621

(58) Field of Classification Search ..... None
See application file for complete search history.

(56) References Cited

U.S. PATENT DOCUMENTS

| | | | | |
|---|---|---|---|---|
| 4,027,590 | A | 6/1977 | Seidl et al. | 101/288 |
| 4,149,458 | A * | 4/1979 | Clary | 101/93.07 |
| 5,518,325 | A | 5/1996 | Kahle | 400/70 |
| 5,542,768 | A | 8/1996 | Rother et al. | 400/120.16 |
| 5,549,444 | A | 8/1996 | Dubuit | 414/796.7 |
| 5,734,629 | A | 3/1998 | Lee et al. | 369/34 |
| 5,873,692 | A | 2/1999 | Costas | 414/796.9 |
| 5,934,865 | A | 8/1999 | Meadows | 414/796.9 |
| 5,946,216 | A | 8/1999 | Hollerich | 364/478.11 |
| 6,021,029 | A | 2/2000 | Mamiya et al. | 360/133 |
| 6,088,049 | A * | 7/2000 | Austin et al. | 347/222 |
| 6,111,847 | A | 8/2000 | Assadian | 369/178 |
| 6,141,298 | A | 10/2000 | Miller | 369/30 |
| 6,327,230 | B1 | 12/2001 | Miller et al. | 369/34 |
| 6,332,680 | B1 | 12/2001 | Ozawa | 347/104 |
| 6,336,757 | B1 | 1/2002 | Nishimura et al. | 400/613 |
| 6,447,181 | B1 | 9/2002 | Hagstrom et al. | 400/120.01 |
| 6,580,444 | B1 | 6/2003 | Drynkin et al. | 347/171 |
| 6,760,052 | B1 | 7/2004 | Cummins et al. | 347/171 |
| 6,840,421 | B1 * | 1/2005 | Urlaub et al. | 225/28 |
| 2002/0131068 | A1 * | 9/2002 | Ishii et al. | 358/1.14 |
| 2004/0156665 | A1 * | 8/2004 | Ng et al. | 400/578 |

FOREIGN PATENT DOCUMENTS

DE 100 10 521 A1 11/2000

(Continued)

*Primary Examiner*—Daniel J. Colilla
(74) *Attorney, Agent, or Firm*—Nickolas E. Westman; Westman, Champlin & Kelly, P.A.

(57) ABSTRACT

A label printer assembly has a support for a supply roll of labels on a flexible web which is fed into an ink jet printer for printing onto a label without contacting the label. After printing, the web carrying the printed label is fed beyond a tear strip to permit removing the printed label by tearing off the web at a space between the labels carried on the web. A feed roller is used to provide a slack loop on the output side of the supply roll that is controlled as to its size during printing, so the drag of the web on the printer feed rollers is reduced. The printer will selectively print bar codes onto the labels.

21 Claims, 11 Drawing Sheets

FOREIGN PATENT DOCUMENTS

| | | | | |
|---|---|---|---|---|
| EP | 0 799 710 | A1 | | 10/1997 |
| EP | 1 120 785 | A1 | | 8/2001 |
| JP | 03043271 | A | * | 2/1991 |
| JP | 2001233510 | A | * | 8/2001 |
| JP | 2002056584 | | | 2/2002 |

* cited by examiner

LABEL PRINTER WITH LABEL SUPPLY FEED CONTROL

This is a continuation-in-part of U.S. patent application Ser. No. 10/938,090, filed Sep. 10, 2004, entitled LABEL PRINTER, now abandoned which is incorporated by reference, and priority on application Ser. No. 10/938,090 is hereby claimed.

BACKGROUND OF THE INVENTION

The present invention relates to a printer for printing information, such as bar codes, on adhesive backed labels. Blank labels are carried on a flexible web from a supply roll that is fed preferably through an ink jet printer. Printing labels using ink jet printing is fast, reliable, and involves a simple mechanism for advancing the roll of blank labels and controlling the feed rate of the roll.

Being able to print a bar code on a label that can then be placed onto a box, product, or any container is useful, and printing the labels quickly, clearly and reliably is important.

Generally speaking, thermal printers or similar printers have been used for bar code printing. The present device provides an ink jet printer of conventional design used in combination with a label loading and feeding mechanism that insures reliable operation of the unit.

SUMMARY OF THE INVENTION

The present invention relates to a printer or processor and a feeder for a roll of a flexible web or backing sheet holding a printable substrate, such as adhesive backed labels. The supply roll is supported and configured so that it will freely feed a supply of labels when a provided printer or processor drive engages the web and the unprinted or blank substrate carried on the web. The printer feeder moves the web at a reliable rate to permit printing of a bar code, for example, by transversely moving fast moving printheads, as shown ink jet printheads. After printing, the printed material, such as a label, moves into a clamp and tear mechanism which clamps the web with a tear edge positioned so that a printed label is just beyond the tear edge, after which the web is clamped so that the label that has been printed can be torn off and used. The printing operation is stopped when the web is clamped, because the web cannot be fed when it is clamped.

An advantage of an ink jet printer is that they are less likely to wear. There is no contact with the surface of the label while printing, so they are not subject to damage from surface imperfection or from debris on the label surface.

The label supply roll in one aspect of the invention is mounted onto a friction drive roller that maintains a slack loop of web on the output side of the supply roll. The slack loop permits easy feeding of the web through the printer. It is important to make sure that there is minimal adverse influence from the label supply roll on the feeding of the labels through the printer. The slack loop size is sensed with a sensor that controls a motor which rotates the label supply roll. The feeder provides a rate of feed to maximize the capabilities of an ink jet printer.

In one aspect of the invention, a light source is directed across a space in which the supply roll and/or a slack loop of the label supply web, is formed. A plurality of light sensors are placed to receive light from the source, and are positioned so that each light sensor will provide a signal related to the size of the slack loop. The light sensor signals are provided to a controller. The light sensors will indicate when the slack loop is close to the roll of labels and the appropriate signal to the controller will drive the supply roll motor to maintain the slack loop in a desired size range.

There is a space between the individual labels on the web and when feeding the labels past the tear bar, the space between labels overlies the tear edge. The printed label is not damaged from the tearing.

Ink jet printers also provide high resolution of the bars in the bar codes. In addition, color printing can be used for the bar code, without added mechanism or complexity.

BRIEF DESCRIPTION OF THE DRAWINGS

FIG. 13 is a perspective view of an opposite side portion of the supply roll guide from. FIG. 12 to show the positions of light sensors for controlling a slack loop from the supply roll.

DETAILED DESCRIPTION OF THE PREFERRED EMBODIMENTS

Figure 1:
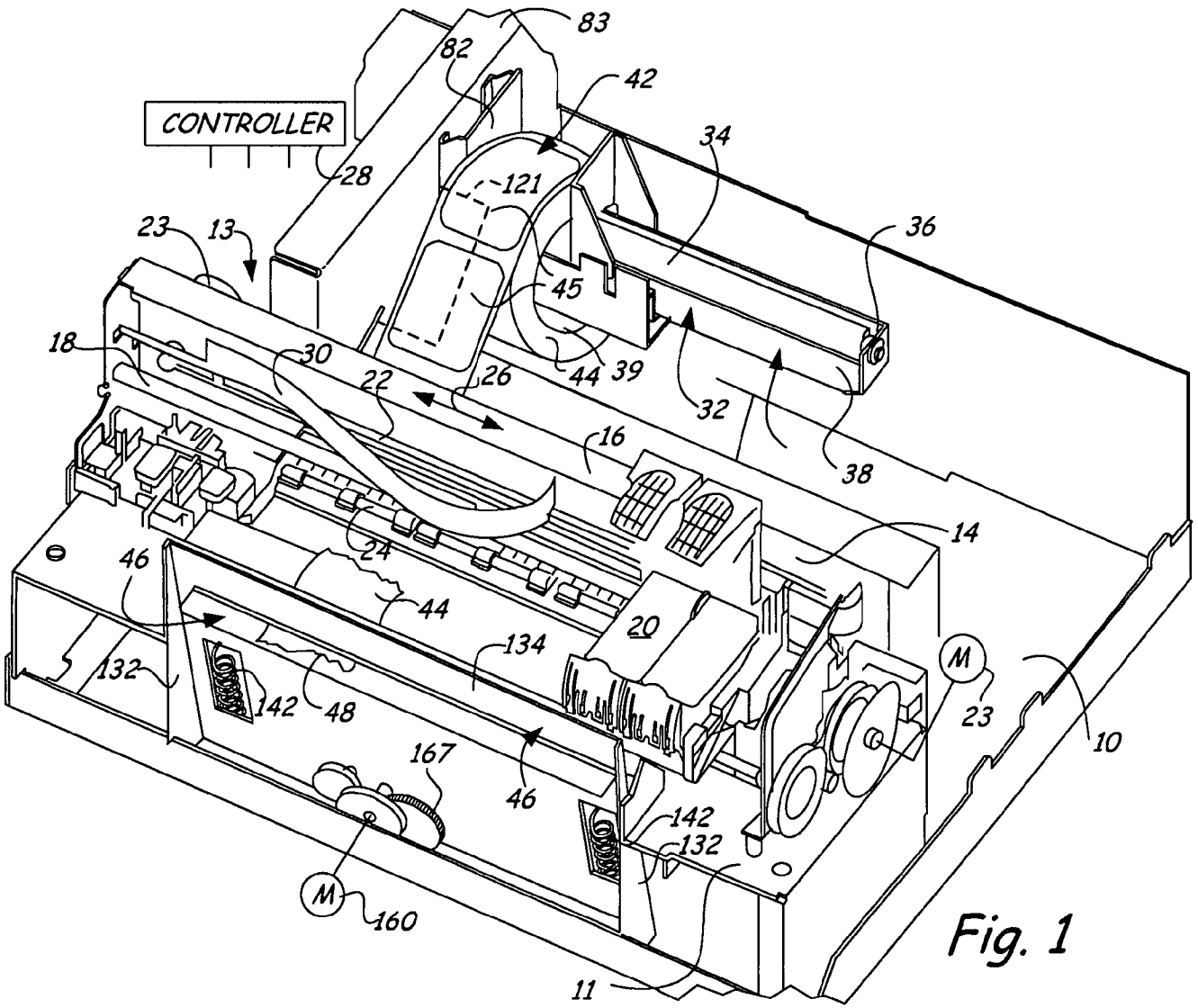
FIG. 1 is a front perspective view of a label printer using an ink jet printing head and made according to the present invention.

Referring to FIG. 1, a base plate forms a support for the various components including ap printer support plate 11. An ink jet printer 13 includes a frame assembly 14 of conventional design that is installed on the printer support plate 11. The ink jet printer frame assembly 14 has a main frame cross rib 16, supporting a guide rail 18 along which print heads 20 are driven in a normal manner, utilizing a controlled DC motor represented schematically at 23 and a drive belt 22. The guide rail 18 extends laterally of the path of labels to be printed.

The ink jet print heads 20 are controlled through a central controller 28 in a normal manner to provide print head movement and printing. The ink jet printer 13 includes feed rollers shown generally at 24 (FIG. 5), that are used for feeding material through an ink jet printer in a normal fashion. The ink jet printer heads 20 travel transversely along the guide rail 18, as indicated by the double arrow 26 (FIG. 1) under control of the central controller 28. The control signals are provided through a ribbon connector 30. The ink jet printheads 20 include a color ink cartridge and a black ink cartridge for printing as desired.

The base plate 10 supports a framework 32 at a rear portion thereof. The frame work supports a driven roller 34 mounted on the framework 38, and includes an outer upright 36 at an outer end of a cantilevered frame channel 38. An inner end of the channel 38 and frame work 32 are mounted on the base plate 10. The roller 34 and frame channel 38 pass through an opening 39 of a center core 40 of a unprinted or blank label supply roll 42. The label supply roll 42 includes a flexible strip or web 44 on which individual, spaced adhesive backed labels 45 are mounted.

The label material can be continuous rather than being pre-cut into separate labels, and after printing, the printer portion can be torn off to separate the labels. The web carries a material that has a printable surface.

The web 44 is shown also at the forward edge of the machine, where a clamp and label tear assembly 46 is supported on the mounting bracket 10. The label clamp and tear assembly 46 also will be more fully explained. The labels 45 are printed with bar codes, or any desired pattern, under control of a program in controller 28, and then moved by the printer drive through a slot in the label and tear assembly 46. The web 44 is clamped, with the printed label protruding out beyond a serrated edge of a tear bar 48, so that the printed label can be torn off.

Figure 5:
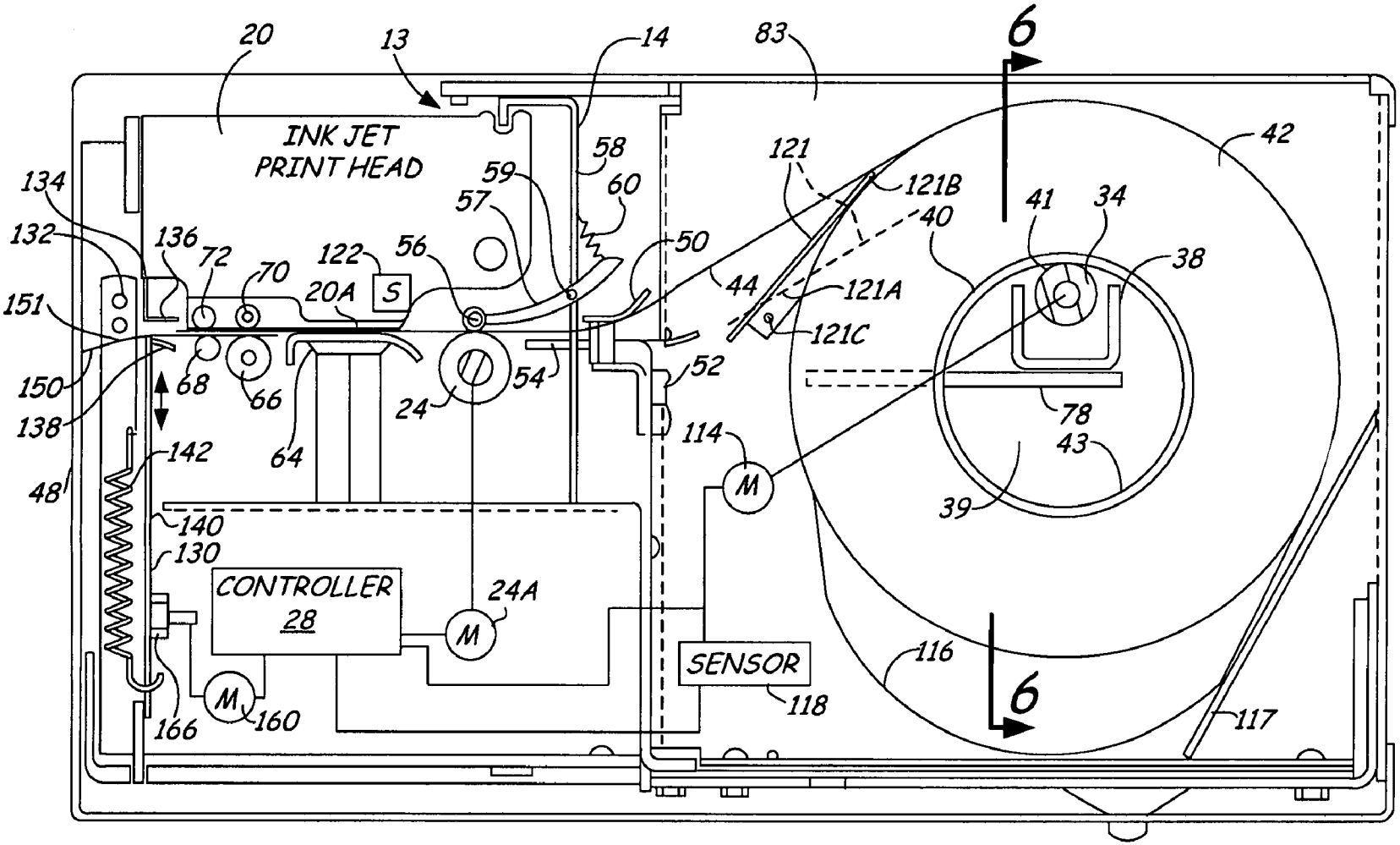
FIG. 5 is a schematic sectional view of the printer of FIG. 1.

Referring to FIG. 5, the core 40 of the label supply roll 42 is shown, with the web 44 and labels carried thereon extending from the roll 42. The cantilevered channel-shaped frame member 38 is also illustrated in cross-section extending through roll core opening 39. The web drive or feed roller 34 has a high friction surface material, such as neoprene or rubber. The core 40 is substantially larger in diameter than the diameter of roller 34 and fits over the roller 34. As shown, the diameter of drive or feed roller 34 is about one fourth the diameter of the opening 39 in core 40 of supply roll 42. The inner surface 43 of core 40 engages surface 41 of the roller 34 with the weight of the label roll 42 being supported by the drive roller 34.

As shown in FIG. 5, a suitable guide 50 is provided on an upright frame panel 52 supported on the base plate housing 10 for guiding the web 44 in its path to the ink jet print heads. The web 44 travels between the guide 50 and a support flange 54 to align the web with the printer drive and feed roller 24.

A spring loaded clamp roller 56 is mounted on an arm 57 which is pivotally mounted at 59 on a frame member 58. The arm 57 and clamp roller 56 are urged with a spring 60 of suitable strength toward the drive and feed roller 24. The web 44 is forced against the drive roller 24 with sufficient force so that when the drive roller 24 is driven by a motor 24A, controlled by the central controller 28, the web 44 will be driven to a position onto or overlying a platen 64 that underlies the ink jet print heads 20. The ink jet print heads 20 have a printing or ink dispensing end 20A, that is spaced from the platen 64 so that the ink jet printer does not contact the labels 45 being printed. The labels, after printing, are then driven by roller 24 and a pair of feed rollers 66 and 68, both of which have a spring loaded clamp roller 70 or 72, respectively, in association therewith, so that the web 44 and the printed label are driven into the clamp and tear assembly 46. The printer feed rollers are shown only schematically, since they form part of a known printer structure.

Figure 6:
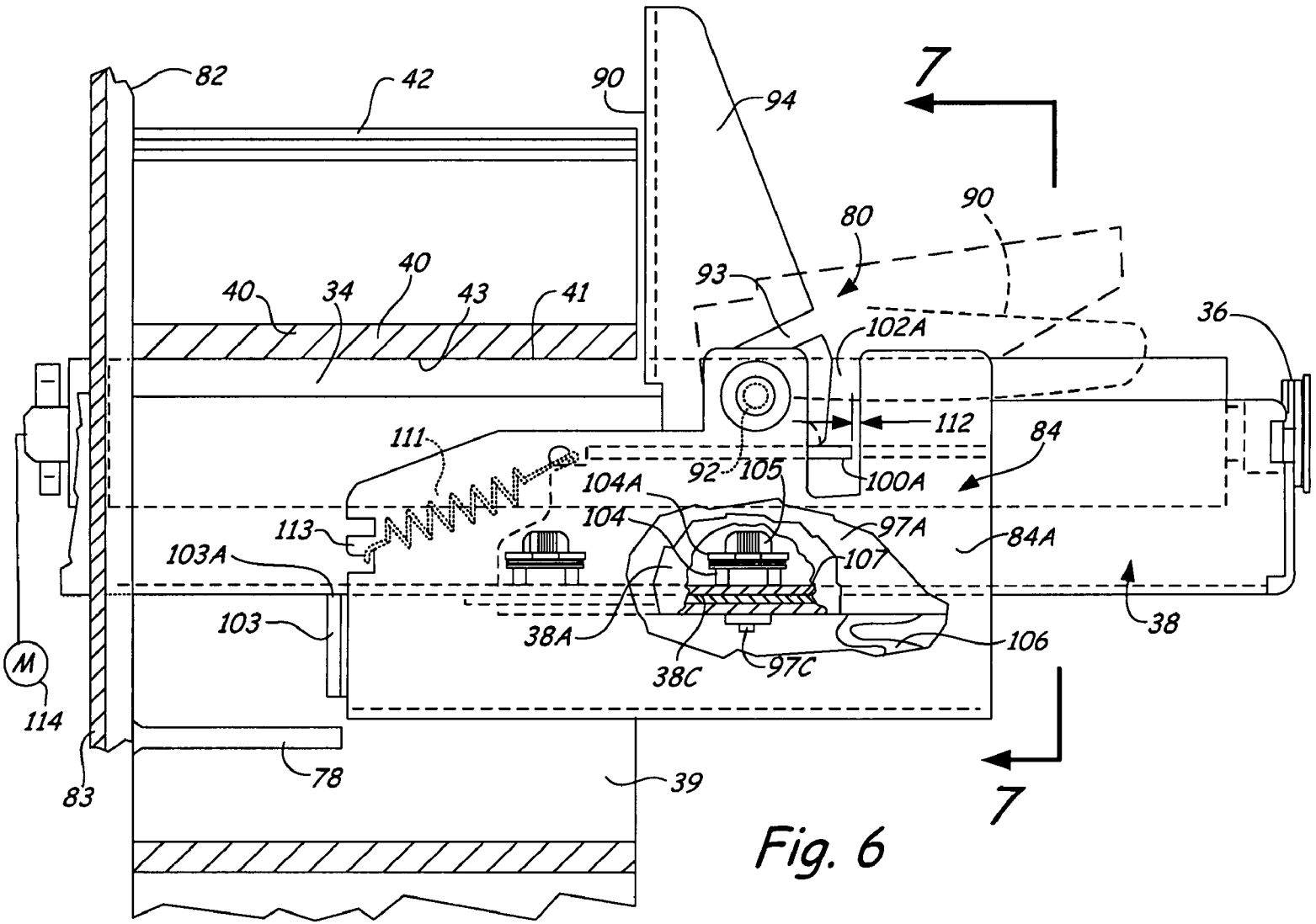
FIG. 6 is a sectional of the label supply roll and guide and taken along line 6—6 in FIG. 5.
Figure 7:
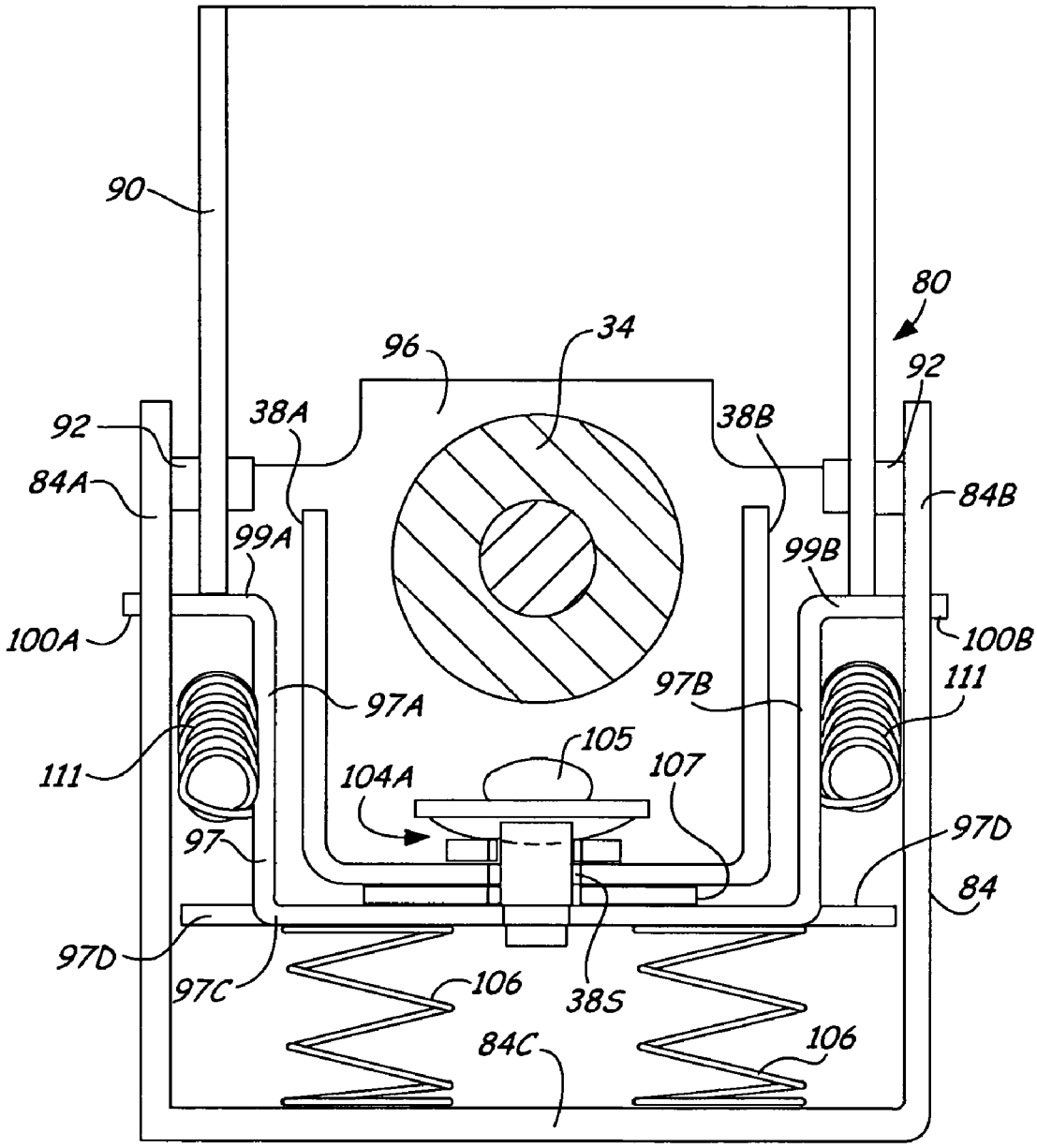
FIG. 7 is an enlarged sectional view taken generally along line 7—7 in FIG. 6.
Figure 8:
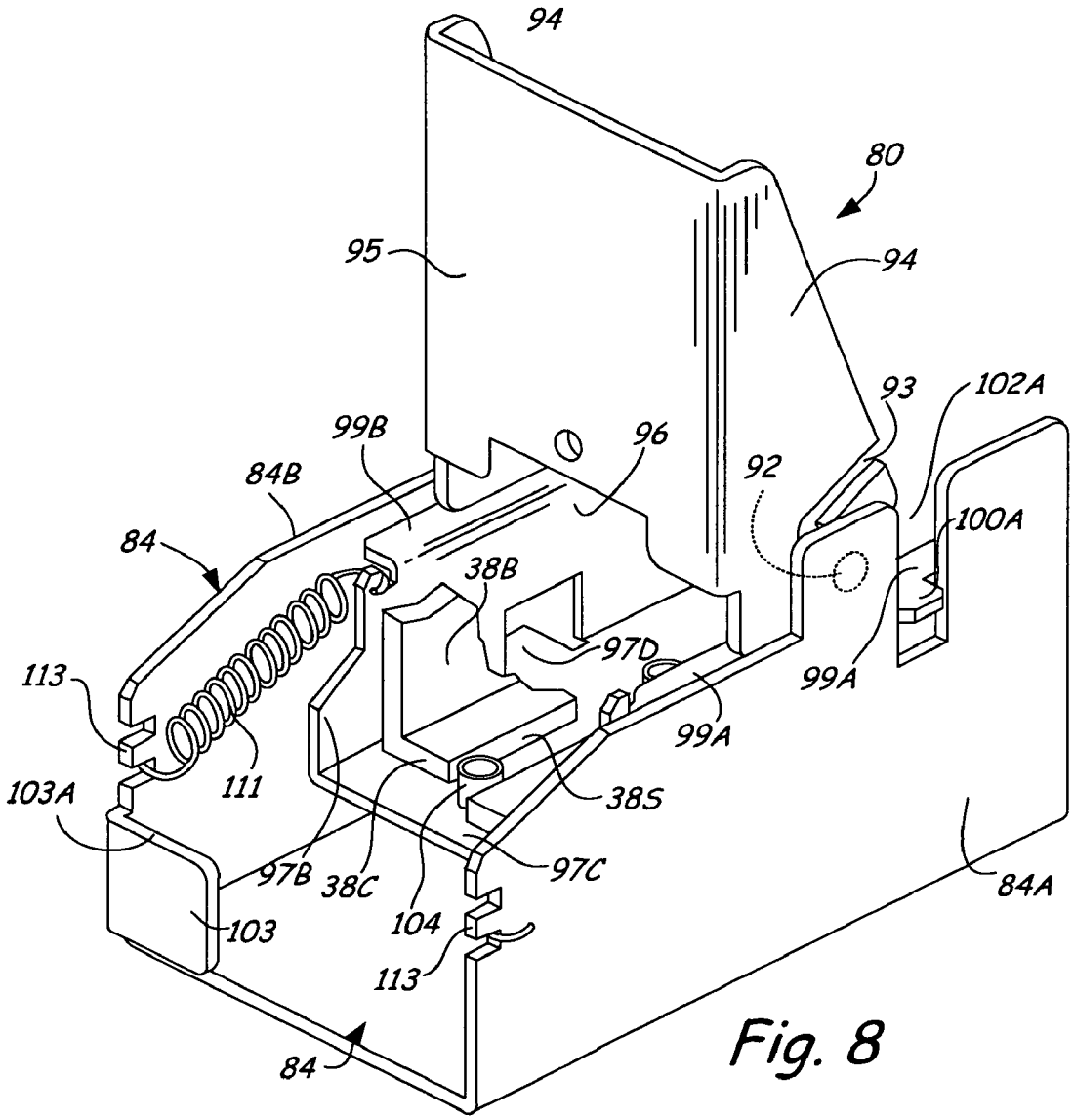
FIG. 8 is an enlarged front perspective view of a label roll guide with parts removed.

The roll core 40 is held in position on roller 34 axially aligned with the web guide and feed rollers, through the use of a fixed guide wall 82 and a movable guide assembly 80, shown in FIGS. 6, 7 and 8. The core 40 is held against the guide wall or plate 82 that is fixed to an upright wall 83. Wall 83 in turn is fixed to base plate 10.

A stabilizing strap 78 is fixed to the guide wall 82 and extends into the opening of core 40. The stabilizing strap is shorter than the interior opening diameter by a small amount, and if the core 40 swings when the roll 42 is driven by rollers 34, the ends of the stabilizing strap 78 will be engaged by the surface 43 defining opening 39 to limit the amount of movement of the core 40.

The guide assembly 80 is slidably mounted on the cantilevered frame member 38 on the outer side of core 40. A friction force is provided against the frame member 38 to keep the guide assembly 80 in a desired axial position on frame member 38. The guide assembly 80 includes a guide carrier 84 that is generally U-shaped and as shown in FIG. 7, has upright side walls 84A and 84B on opposite sides of the U-shaped cantilevered frame member 38. The guide carrier 80 has a bottom wall 84C that joins the spaced upright walls of 84A and 84B. The upright walls 84A and 84B of the guide carrier are spaced from the upright walls 38A and 38B of the cantilevered frame member 38.

A guide flange or finger 90 is pivotally mounted onto the upright walls 84A and 84B with suitable pivot pins 92. The pins 92 are fitted in L-shaped slots 93 in side members 94 to permit the guide flange 90 to pivot. The guide flange 90 has a base wall 95 that extends across the guide carrier and across the driver roller 34. The base wall 95 of the guide flange has a lower edge above the side walls 38A and 38B of the frame member 38. Additionally, the base wall 95 of the guide flange 90 has a notch 96 in the center of the lower portion that is of a width and length to clear the drive roller 34 to the extent that the guide flange 90 can be pivoted about the pins 92 to a position generally shown in dotted lines in FIG. 6.

Figure 2:
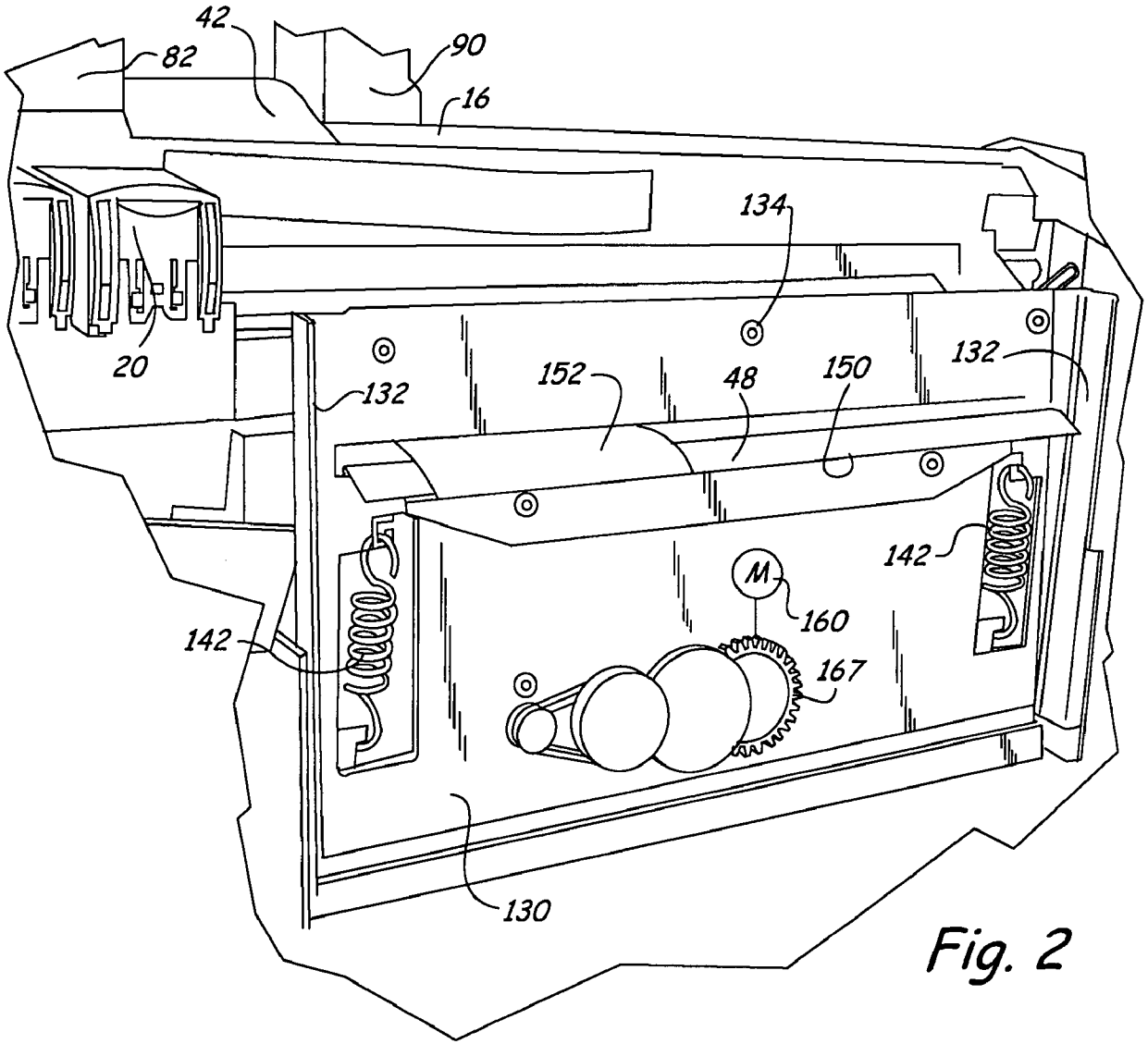
FIG. 2 is a fragmentary front perspective view of the printer of FIG. 1 at an opposite angle from FIG. 1.
Figure 3:
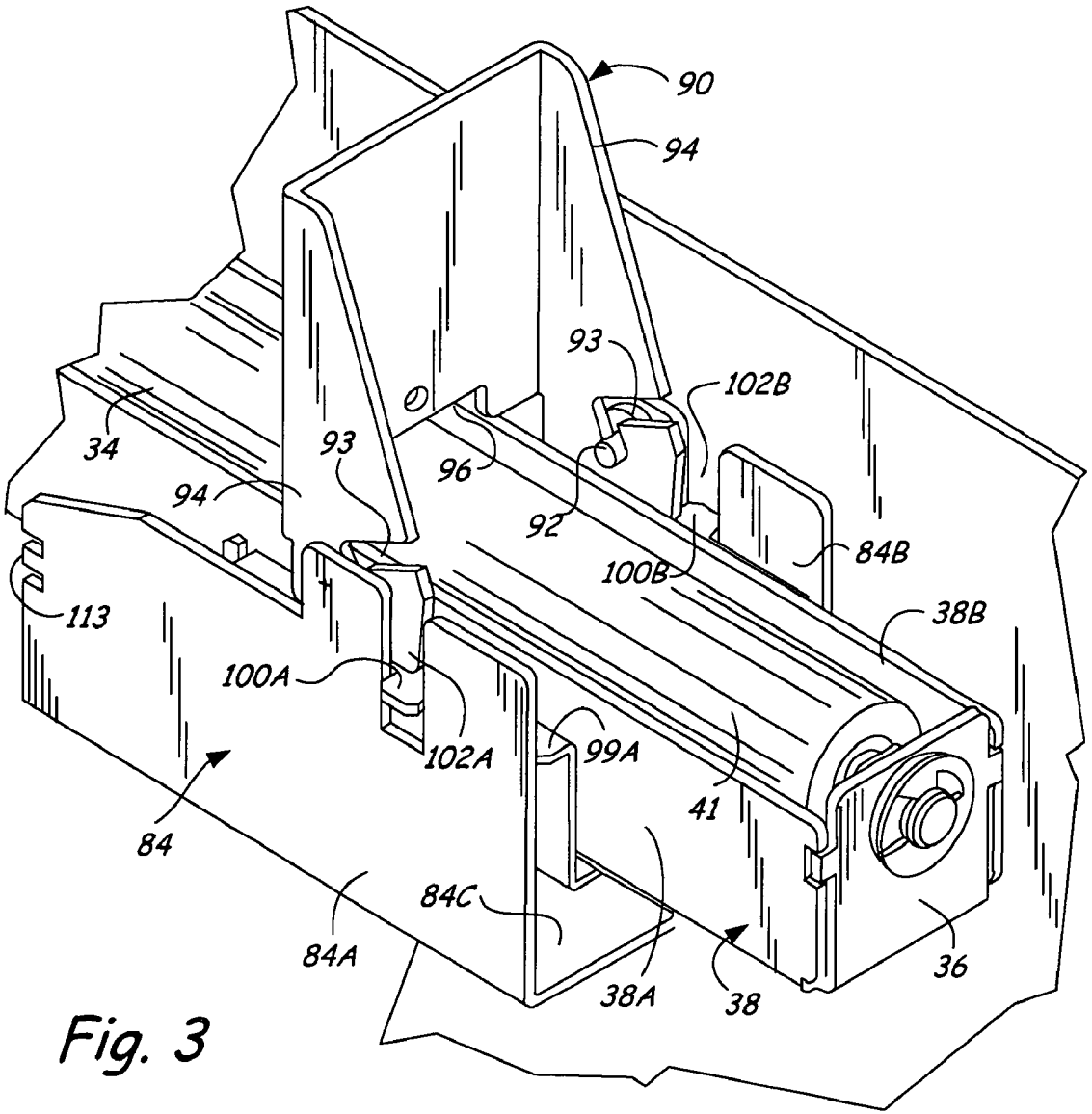
FIG. 3 is a fragmentary front perspective view of a supply roll drive roller and guide.

When the guide flange 90 is pivoted to the dotted line position, the outer end of the guide flange is close enough to the roller 34 so that the core 40 of the label supply roll 42 can be slipped over the free end of the frame member 38 and over the; guide flange. The core 40 then is slid against guide wall 82. The frame member 38 is a cantilevered member, and is not supported at its outer end shown in FIGS. 1 and 2. The cantilevered frame member 38 is supported on or adjacent to the wall 82 or directly supported on base plate 10. The cantilever frame member 38 permits the label supply roll 42 and the core 40 to be slipped off or on the drive roller 34 after pivoting the guide flange about the pins 92, for reloading the label supply.

The side walls 84A and 84B support a U-shaped saddle 97 that has a base wall 97C, and upright side walls 97A and 97B with flanges 99A and 99B that are outwardly extending from walls 97A and 97B. The flanges 99A and 99B have ears 100A and 100B that extend through slots 102A and 102B in the walls of guide carrier 84.

The saddle 97, and thus the guide carrier, is frictionally loaded against the bottom wall 38C of cantilevered frame member 38 so that the guide carrier 84 can be slid to properly position the guide flange 90 against the end of the core 40 of a properly positioned label supply roll 42. The guide carrier. 84 also has a front stabilizing tab 103 that has an upper edge 103A that will engage the bottom wall 38C of frame member 38 to stabilize the guide carrier 84 and insure the guide carrier is parallel with the frame member 38.

Figure 4:
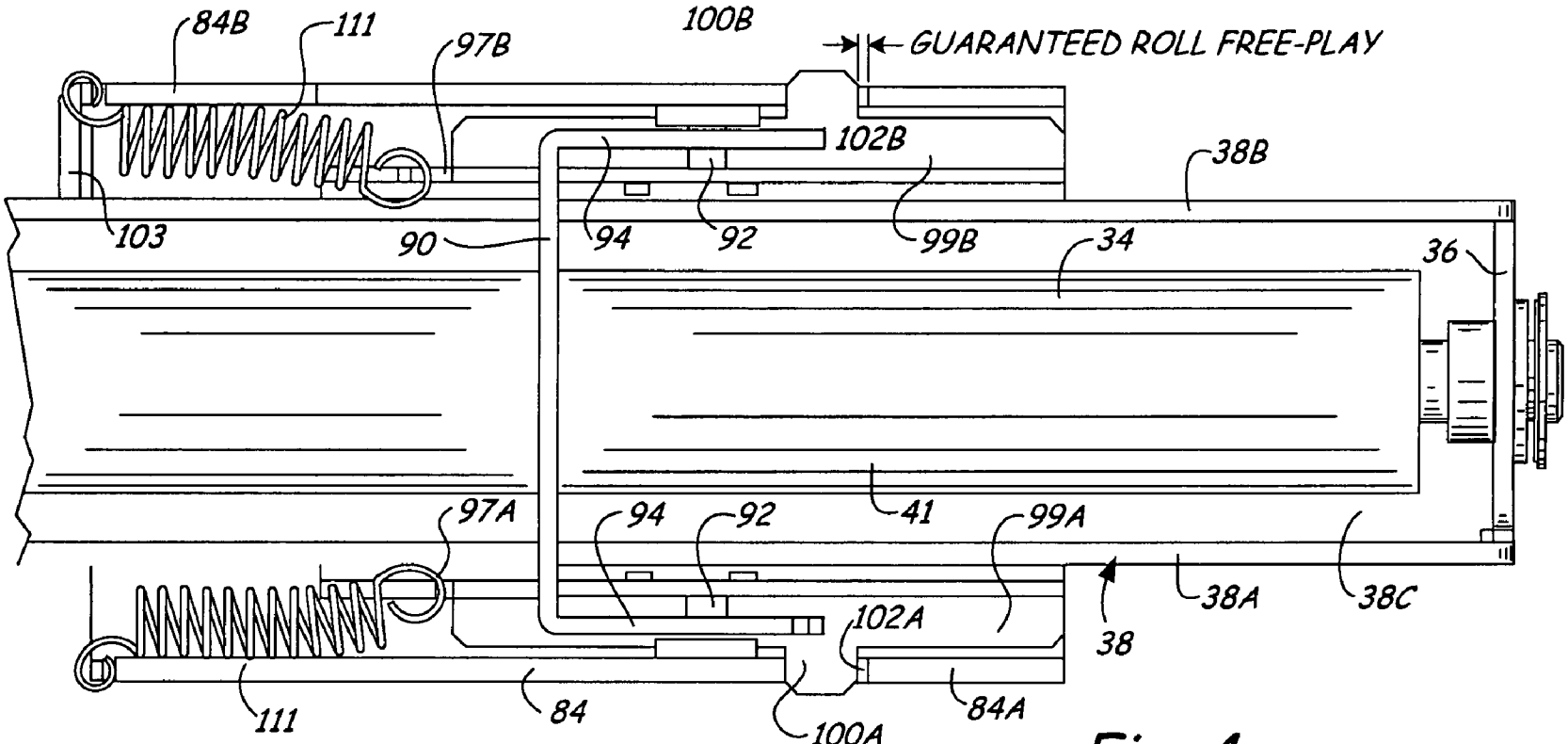
FIG. 4 is a fragmentary top plan view of the drive roller and guide shown in FIG. 3.

The wall 97C of saddle 97 is mounted below the base wall 38C of cantilevered frame member 38, and is above the base wall 84C of the guide carrier. The ears 100A and 100B that extend through slots 102A and 102B in the guide carrier side walls 84A and 84B have a clearance space 112 (FIGS. 4 and 6) relative to saddle 97 and the edges of the slots 102A and 102B.

The friction load on the guide carrier 84 is provided by a pair of springs 106 (see FIGS. 7 and 8) that are supported on base wall 84C and bear against the bottom surface of the wall 97C. The wall 97C or saddle also has a pair of guide sleeves 104 that slidably fit into a slot 38S in the base wall 38C of the cantilevered frame member 38 (see FIG. 8), for guiding the sliding movement of the saddle 97 and guide carrier 84 along the frame member 38.

The sleeves 104 each receive a small spring and washer assembly held with a capscrew 105 in the sleeve to stabilize the parts. A wear plate 107 of low coefficient material is used between walls 38C and 97C.

The difference in the size of the ears 100A and 100B and the openings 102A and 102B in the guide carrier 84 indicated by spacing 112 provides an automatic positioning of the guide flange 90 relative to the core 40 so there is no binding.

A pair of tension springs 111 have first ends secured to tabs 113 on side walls 84A and 84B. The other ends of springs 111 are secured to tabs 115 on the ends of walls 97A and 97B to urge the ears 100A and 100B to the edge of slots 102A and 102B closest to the supply roll core 40. When the core is installed, the guide carrier 84 and guide flange 90 are slid against the end of the roll core 40 manually until the guide carrier is stopped. This will force the ears 101A and 100B against the trailing edges of slots 102A and 102B. When released from force, the springs 111 will return the ears 100A and 100B to the position shown in FIGS. 6 and 8, so the guide flange 90 is spaced from the roll core and does not place a drag on core 40. The springs 111 act between the saddle 97 and guide carrier 84. The saddle remains in position on frame member 38 while the guide carrier moves as permitted by the ears 100A and 100B and slots 102A and 102B.

The drive roller 34 is driven with a motor 114 (see FIG. 5) that is operated in response to control signals from the controller 28. In order to provide for very low load feeding of the label web 44, the web 44 is formed into a loose or slack loop 116 as a last loop before feeding the end of the web from the supply roll 42, as shown in FIG. 5. This slack loop 116 is such that the web forming the loose loop can move easily when the web is driven by the printer feed without turning the roll 42.

The loop 116 is held forwardly (toward the printer) by a guide plate 117. The label web 44 can be fed by the drive roll 24 for the printer and the drive rollers 66 and 68 on the output side of the printer with very low forces.

The web length is kept from sagging between the supply roll 42 and the guides 50 and 54 with a dancer or guide plate 121 that has a flange 121A pivotably mounted on wall 83 at a pivot pin 121C. An end 121B of the dancer plate rides on the outer periphery of the supply roll, on the side toward the printer. The plate 121 extends axially or laterally sufficiently to support the web, but does not have to extend the full width of the supply roll. The pivot 121C is free enough so that as the web forming the supply roll is used and gets smaller, the end 121B continues to engage the outer surface of the supply roll. The position and size of loop 116, which forms on the underside of supply roll 42 under gravity forces, is sensed with an infrared sensor or other suitable sensor 118. Sensor 118 is a reflective sensor and is located in a desired position to insure that the loop 116 will be maintained between a minimum and a maximum size. The guide plate 117 supports loop 116 so the sensor 118 will sense the loop as the supply roll is used and the diameter changes. The guide plate 117 stabilizes the loop 116 and keeps it positioned toward sensor 118.

The motor 114 is driven to maintain the desired loop size in response to signals from sensor 118. The surface 41 of drive roller 34 frictionally drives on the inside surface 43 of the core 40. The drive to core 40 is not a positive drive, but friction between the roller 34 and the inner surface 43 of the core 40 will rotate the label supply roll to maintain the slack loop 116 size within limits.

The loose or slack loop results in the length of the web infeed portion engaging the supply roll being less than 180° around the supply as the web is pulled into the printer, and this length of web from the loop slides along the surface formed by the supply roll as the web is fed. The printer feed rollers do not have to overcome substantial friction while sliding the web, and the printer feed rollers do not have to rotate the supply roll 42 in order to feed labels into the printer.

The sensing of a label position relative to a print head for printing is done with suitable sensors on the printer, that will sense the leading edge of a blank label 45. There are spaces between the labels 45 as shown. A sensor, conventional for printers, initiates the printing as soon as the web has been moved a selected distance after a label edge is sensed. Such a label sensor is shown schematically at 122 on the printhead 20 in FIG. 5. If the printable label layer on the web is continuous, the web can be indexed with other sensor or encoders for the printer feed rollers.

Figure 9:
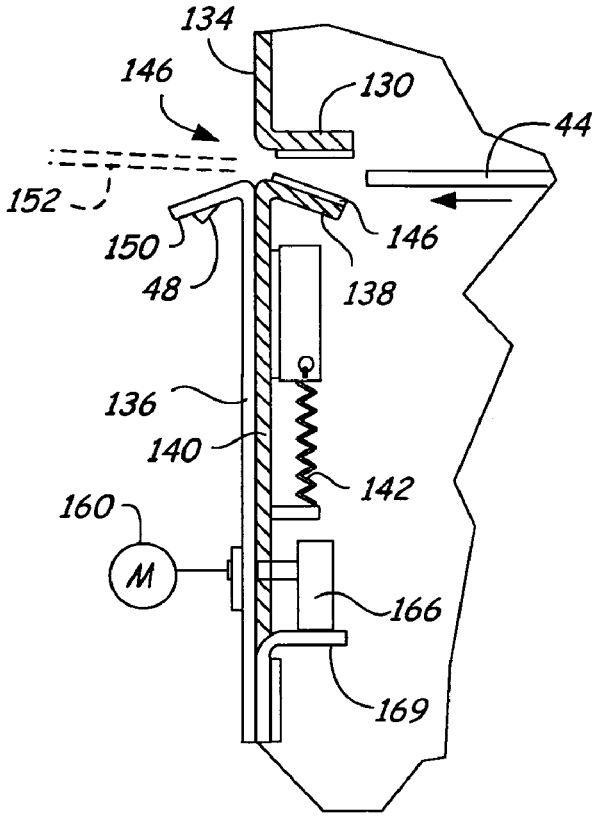
FIG. 9 is a schematic representation of a cam lift arrangement for clamping the web of labels after printing.
Figure 10:
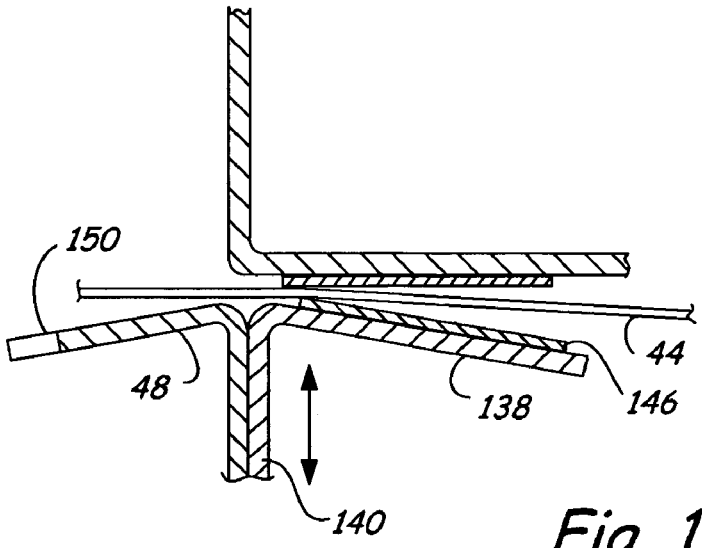
FIG. 10 is an enlarged fragmentary sectional view of a web clamp and tear arrangement.

The clamp and tear assembly 46 is shown in FIGS. 1 and 5, and details are shown in FIGS. 9 and 10. The clamp and tear assembly 46 is mounted on a frame front wall 130 that is supported in a suitable manner on the mounting bracket 10. Upright members 132 are on opposite ends of the wall 130, and on a side away from the printer heads 20. The upright members 132 support a fixed cross member 134 that has a flange 136 that extends toward the print heads and overlies the web 44. The web 44 is supported on a flange 138 of a vertically slidable plate 140. The slidable plate 140 is slidably mounted relative to the wall 130 in a suitable manner such as using edge guides, and is spring loaded upwardly with suitable springs 142 (FIGS. 1 and 2) that urge the web support flange 138 toward the fixed flange 136. A cam roller 166 (FIG. 9) controlled by a motor 160 acts on a cam bar or flange 169 on the slidable plate 140 to hold the flange 138 of slide plate 140 spaced from the flange 136, except when the controller 28 operates motor 160 to move the cam so springs 142 act to clamp the web 44.

Therefore, there normally is a space between flanges 136 and 138 through which the web 44 and printed labels carried on the web 44 can pass unobstructed. The flange 138 is inclined downwardly, as shown in FIGS. 5, 9 and 10, to provide a lead-in angle so that the web 44 will be fed through the space between flanges 138 and 136 relatively easily. The support flange 138 has a high friction material strip 146 thereon, and the overhead flange 136 also can have a high friction material strip 148 thereon to insure that when the cam 166 releases, the slide plate 140 slides upwardly under the force of the springs 142 and the web 44 will be clamped. The tear edge shown at 150 on the fixed tear bar 48 is serated and is used for tearing off a protruding label 152.

Motor 160 rotates the cam 166, which normally is in a position holding the slidable plate 140 down, so the web is not clamped. When the controller 28 provides a signal that a label is protruding from the tear strip, and printing has been suspended, the cam 166 is rotated to release the slidable plate 140 so that springs 142 pull the slide plate up and flange 138 clamps the web 44 against the flange 136. The high friction material strips hold the web with printed label 152 extending outwardly from the tear edge 150. The protruding printed label then can be torn off from the web easily. Printer label 152A (FIG. 2) will next be extended by the printer for removal. The cam 166 is then rotated to move the flange 138 downwardly again. While the cam 166 is shown schematically, a gear drive 167 on the outside of the fixed plate 130 (FIG. 1) is used to drive the cam against the cam follower or flange 169 on the slidable plate 140. The cam follower 169 is on the interior of the printer housing.

The high speed, accurate ink jet print heads 20 of known design can thus be utilized for printing bar codes in either black and white or color, quickly, easily and reliably utilizing the simplified mounting for the label supply roll and using a suitable drive. The clamp and tear assembly for tearing off the labels in groups or individually when printed is on the output side of the printer.

Again, the ink jet printer can be a standard printer (a color printer, if desired, for making colored labels), using a standard frame, drive and control made by Lexmark, Inc. The printer frame can be installed on the bracket 10 along with the support for the label supply, the tear strip, and additional drive rollers as needed.

The clamping of the web 44 with the clamp and tear assembly is done only when a printed label or a group of printed labels is to be torn off. The printable material on the web can be continuous instead of separated and the printed label torn off to separate labels after printing.

The clamp flange 138 also is held open during printing since the web needs to be moved back and forth for a particular pattern of printing. The clamp is only actuated when tearing is to take place. When there is no printing being done, or when the printer is not "on", the web also will be clamped by the springs so that it will not be accidentally pulled out of the printer.

Utilizing a loose loop of the web coming off the supply roll, and positioning it below the supply roll for sensing the loop size and driving the supply roll to maintain this loop, means that a feed of the web to the printer at a high rate of speed can be maintained. The sensor 118 sensing the loose or slack loop 116 can be for a proportional drive, so that when the loop is small, the drive can be faster, and when the loop is sensed as being large, the drive motor for roll 34 would be reduced in speed or stopped.

The drive for the label supply roll and the use of a loose or slack loop for feeding to the printer will be advantageous for other types of printers as well.

Figure 11:
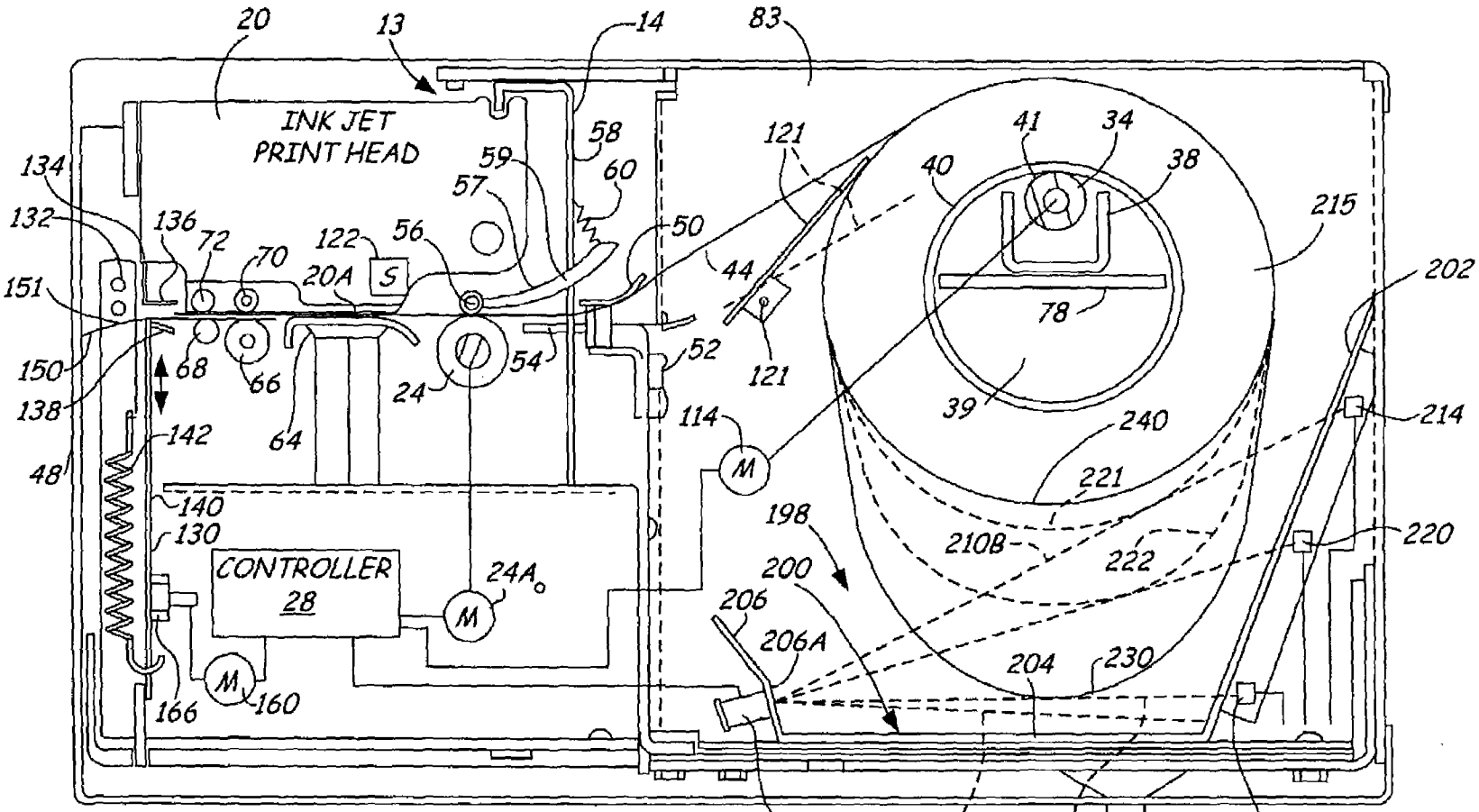
FIG. 11 is a view similar to FIG. 5 with a modified slack loop sensor arrangement for controlling a supply roll drive.
Figure 12:
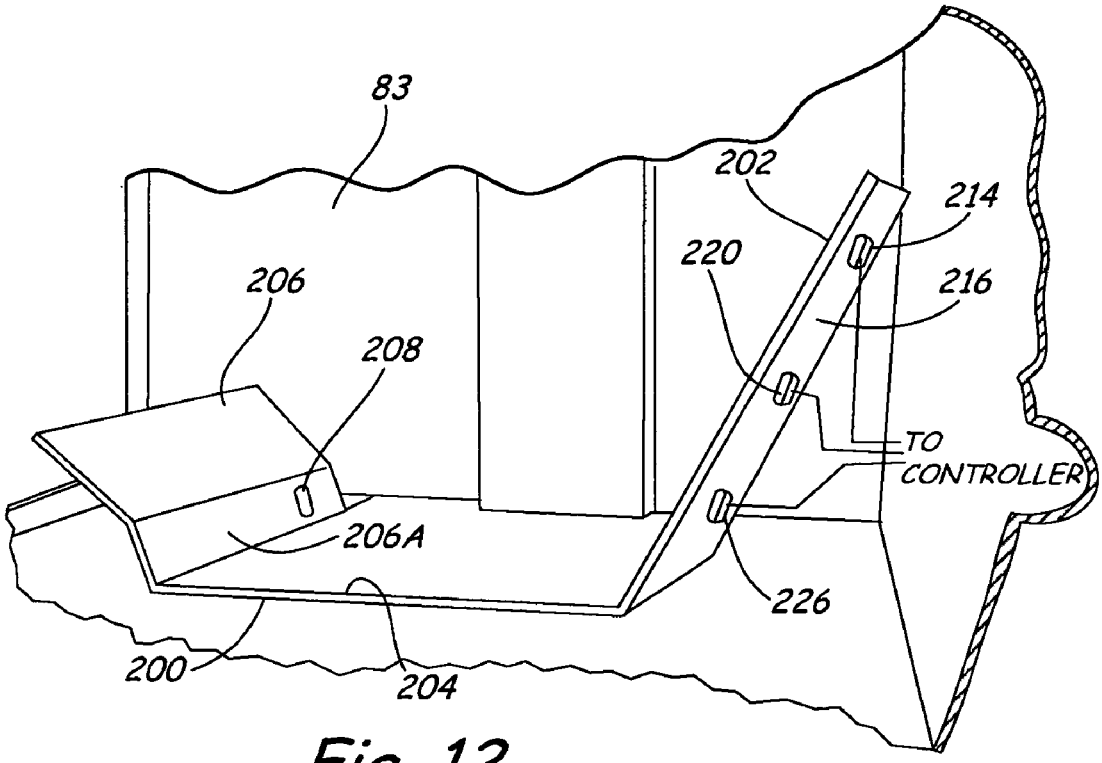
FIG. 12 is a fragmentary perspective view of the supply roll guide showing the position of a sensor light source.
Figure 13:
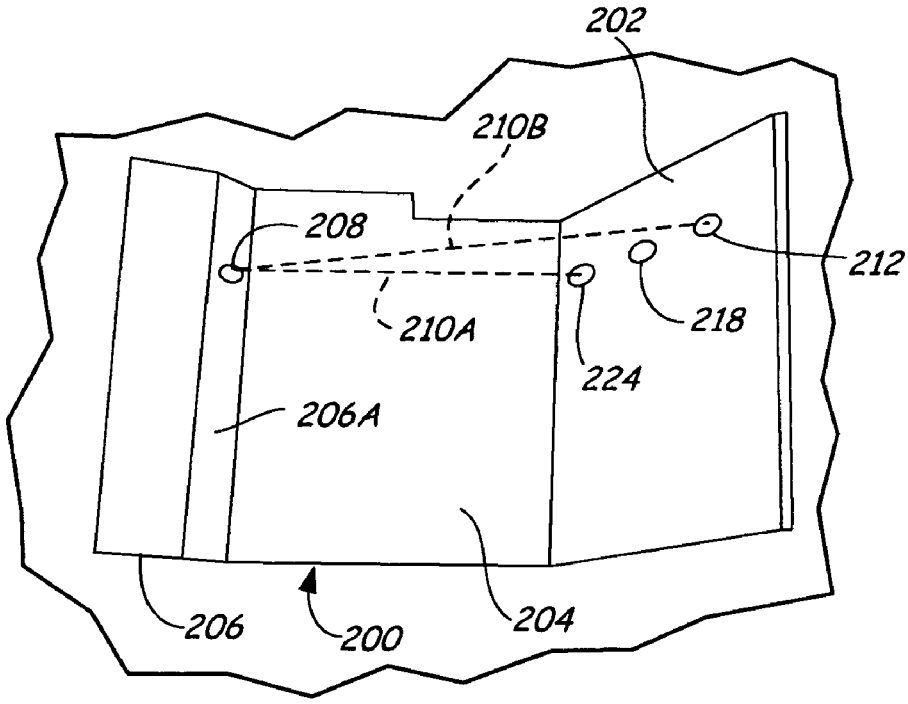

A modified sensing system for sensing the size of the loose or slack loop formed by the web carrying illustrated in FIGS. 11, 12 and 13. In this form of the invention, the sensor 118, which can be a reflective sensor, is replaced with a sensing or sensor system 198 which includes a plurality of sensors providing signals that will indicate the size of the loop in stages.

The guide plate 117 is replaced, as shown in FIG. 11, with a guide plate assembly 200, which includes an inclined guide plate portion 202 that is positioned similarly to guide plate 117. The guide plate assembly 200 has a base wall 204 supported on the bottom wall of the housing for the label supply. A flange 206 that has a generally upright portion 206A is supported on base wall 204. A light source 208, such as an LED light source, is supported on the upright portion 206A of flange 206 and it is powered from the controller 28. It should be noted that the parts with the same numbers as in the previous form of the invention are for the same parts. The drive roller 34 is shown raised from its previous position to accommodate the different sensing system.

The LED light source 208 for the sensor system 198 projects a cone shaped light beam that is defined schematically by dotted lines 210A, for a lower line, and 210B for an upper line. This light then will pass across the region below the supply roll 215, and any slack loop from the roll. The upper portion of the light beam bounded top line 210B will be received through an opening 212 (see FIG. 13) on the guide plate portion 202, and with no loop of web in the way, will strike an LED light sensor 214 mounted onto a sensor support 216 that is in turn attached to the plate 202.

When the loose feed loop from supply roll 215 is at the dotted line position shown at 221 in FIG. 11, the loop will not block the light to sensor 114, and when sensor 114 receives light the system is indicating that that the roll 215 can be driven fast, because the feed loop is small, by driving the motor 114 to rotate the drive roller 34.

An intermediate size sensing opening 218 is provided in the guide plate 202, and is aligned to receive light from the light source 208 of the sensor assembly 198, and a light sensor 220 which is mounted on support 216 in alignment with the opening 218. When light is received by the sensor 220, with a loop size between the dotted loop position 221 and an intermediate loop size shown at dotted lines at 222, it is known that the roll can be driven, and this can be at a different speed.

Once the loose feed loop gets larger than the loop indicated by dotted lines 222, and is below a line 227 representing the light beam level below which sensor 220 is blocked from light from source 208, the drive motor 114 can be slowed. The infeed loop is know to be adequate for feeding labels to the print head.

The third or large loop sensing opening shown at 224 in FIG. 13, has a sensor 226 aligned with this opening to sense when light from the light source 208 is blocked by a loop shown in solid lines at 230. When light along and below dotted line 229 is blocked from sensor 226, the drive motor 114 is stopped so the supply roll 225 usually does not rotate until the sensor 226 again receives light.

The signals from the light sensors 214, 220 and 226, which can indicate light or no light are provided to the controller 28 and used for portionally driving the motor 114 at proper times and at a desired speed to maintain the slack feed loop of the web in between desired limits and ensure that the printer feed rollers will only be pulling a free length of the web carrying labels forming a slack loop. The printer feed rollers thus will not have to rotate the supply roll.

The sensor arrangement shown in FIGS. 11–13 permits the use of any type or color of a label stock because the sensor arrangement does not depend on reflectivity for sensing, and the arrangement is not subject to variations in the reflectivity of different brands and finishes of white label stock. In other words, the sensing system 198 shown in FIGS. 11–13 is dependent upon light transmission, not light reflectivity. The ability to control the slack loop that extend from the roll, regardless of the stock remaining on the roll, provides for a smooth control of the supply roll drive. This feature of blocking light to control the loop size also works with one or two sensors, as well as the preferred three sensors as shown.

Since the slack loop from the supply roll 215 is formed by gravity and the core 40 is resting on the drive roller 34 under gravity, the sensors 214, 220 and 226 that sense light are positioned at different vertical distances from base 204 along a vertical reference line passing through the axis of the drive roller 34. They will thus sense the vertical distance of a light blocking web from the axis of the drive roller.

The loop of web material is easily pulled by the supply drive for the printer or processor (such as a laminator or another type of printer) and the separate roll drive will make sure the loop is provided so the printer or processor does not have to rotate the supply roll.

Although the present invention has been described with reference to preferred embodiments, workers skilled in the art will recognize that changes may be made in form and detail without departing from the spirit and scope of the invention.

What is claimed is:

1. A printer and feeder assembly for printing labels carried on a flexible web of material formed into a supply roll, the supply roll having a central opening therethrough, the printer and feeder assembly comprising a housing, a supply roll support on the housing for supporting the supply roll, a feeder for feeding the web from the supply roll, a printer having a print station with a print head, the web being directed through the print station with a printable surface thereon facing the print head for printing, and a roll drive for moving the supply roll to maintain a slack web loop on an output side of the supply roll, the roll drive comprising a drive roller mounted on an interior of the central opening of said supply roll and frictionally engaging a portion of an inner surface of the central opening of the supply roll, said drive roller being substantially smaller than the central opening of the supply roll, said supply roll being rotationally driven by rotating the drive roller, the slack web loop comprising a portion of the web that extends from the supply roll and below the supply roll, the web forming the slack web loop passing over an upper side of the supply roll and the web extending from the upper side of the supply roll to the print station, a sensor for sensing the position of the slack web loop at a lower side of the supply roll, and a motor to drive the drive roller in response to signals from the sensor.

2. The printer and feeder assembly of claim 1, wherein said web is fed from the print station through an unclamped clamp mechanism, said clamp mechanism being operable to clamp onto the web with a printed portion of the printable surface of the web extending to an exterior of the clamp mechanism.

3. The printer and feeder assembly of claim 2, and a tear strip for tearing off the printed portion that has passed through the clamp mechanism, after the web is clamped by the clamp mechanism.

4. The printer and feeder assembly of claim 1, wherein the sensor comprises a light source and at least one light sensor, the at least one light sensor being spaced from the light source and the slack web loop being formed in a space between the light source and the at least one light sensor, the at least one light sensor being spaced vertically to sense when light is blocked from reaching the at least one light sensor.

5. The printer and feeder assembly of claim 4 wherein there are a plurality of light sensors spaced from the light source and also spaced vertically from each other.

6. A printer and feeder assembly for printing labels carried on a flexible web of material formed into a supply roll, the supply roll having a central opening therethrough, the printer and feeder assembly comprising a housing, a supply roll support on the housing for supporting the supply roll, a feeder for feeding the web from the supply roll, a printer having a print station with a print head, the web being directed through the print station with a printable surface thereon facing the print head for printing, and a roll drive for moving the supply roll to maintain a slack web loop on an output side of the supply roll, the central opening of the supply roll having a central axis about which the supply roll moves as the web is directed through the print station, and wherein said supply roll support comprises a drive roller supported on a cantilevered frame member that fits within the central opening of the supply roll, a guide carrier slidably mounted for axial movement along the cantilevered frame member, and a guide flange mounted on the guide carrier and engaging an outer side of the supply roll to position the supply roll along the cantilevered frame member.

7. The printer and feeder assembly of claim 6, wherein the guide flange is pivotally mounted on said guide carrier for pivoting between a position generally perpendicular to the central axis of the supply roll, to a position wherein the guide finger is inclined along said drive roller and cantilevered frame member to permit the drive roller, guide flange, guide carrier, and cantilevered frame member to pass through the central opening of the supply roll for loading and unloading the supply roll.

8. The printer and feeder assembly of claim 6, wherein the drive roller is driven in response to selected signals indicating presence of a slack loop on an output side of the supply roll.

9. The printer and feeder assembly of claim 6 wherein the central opening in the supply roll has a first diameter, and the drive roller has a second diameter substantially smaller than the first diameter.

10. The printer and feeder assembly of claim 6 and a clamp and tear assembly to receive the web after a printable surface portion of the web has been printed, the clamp and tear assembly comprising a clamp member moveable toward and away from a fixed reaction member, the web passing through a space between the clamp member and the fixed reaction member when the clamp member is moved away from the fixed reaction member, a biasing member providing a force for urging the clamp member toward the fixed reaction member, and a drive member operable to retain the clamp member spaced from the fixed reaction member against the force of the biasing member when the printer is printing, the drive member being operable to permit the force of the biasing member to move the clamp member toward the fixed reaction member at selected times to thereby clamp the web there between, and prevent movement of the web past the clamp member with a printed surface portion of the web positioned to an exterior of a tear strip forming part of the clamp and tear assembly.

11. A printer assembly comprising a printer having a print head, printer feed rollers for feeding a web past the print head for printing, the web being formed into a supply roll having a central opening with a central axis, a supply roll support comprising a drive roller supported on a cantilevered frame member that fits within the central opening of the supply roll, a first fixed wall at one end of the cantilevered frame member for guiding a side of the supply roll, a guide carrier mounted for axial movement along the cantilevered frame member, and a guide flange mounted on the guide carrier on a side of the supply roll opposite from the fixed wall to guide the supply roll to a selected position on the cantilevered frame member relative to the fixed wall.

12. The printer assembly of claim 11, wherein the web is a substrate movable under the print head, a controller for operating the printer print head for printing on material on a surface of the web as the web is moved under the print head, clampable members spaced apart for receiving the web after printing, and the clampable members being operable to move together to clamp the web with a portion of the web having printing thereon extending outwardly from the clampable members, and a tear strip outwardly of and adjacent the clampable members against which the web can be moved for tearing off a printed portion of the web extending outwardly from the clampable members.

13. The printer assembly of claim 12, wherein said web comprises a label, and the printed portion extending outwardly of the clampable member having a bar code printed with the printer print head.

14. The printer assembly of claim 11, wherein said supply roll has a tubular core mounted on a second feed roller, said second feed roller rotating the core and the supply roll when driven, and forming a loose web strip loop as the web strip is exiting the supply roll, the web strip on an output side of the loose web strip loop sliding on an upper side of the supply roll as the printer feed rollers feed the web strip to the print head, and a drive for said second feed roller to maintain the loose web strip loop in a desired size range.

15. The printer assembly of claim 14, and a sensor assembly for sensing the loose web strip loop comprising a sensor signal source and at least one sensor signal receiver, the at least one sensor signal receiver being positioned to receive the sensor signal when the loose web strip loop is clear of a line between the sensor signal source and the at least one sensor signal receiver to indicate the size of the loose web strip loop, signals from the at least one sensor signal receiver controlling the drive for the second feed roller.

16. The printer assembly of claim 11, wherein the guide flange is pivotally mounted on said guide carrier for pivoting between a position generally perpendicular to the central axis of the supply roll, and a position wherein the guide flange is inclined along said drive roller and cantilevered frame member to permit the drive roller, guide flange, guide carrier, and cantilevered frame member to pass through the central opening of the supply roll for loading and unloading the supply roll.

17. The printer assembly of claim 11, wherein the drive roller is driven in response to selected signals indicating presence of and size of a slack loop on an output side of the supply roll.

18. The printer assembly of claim 11, wherein the printer feed rollers are spaced from the supply roll, and further comprising a pivotally mounted dancer plate located below a portion of the web between the supply roll and the printer feed rollers to support the web.

19. The printer assembly of claim 18, wherein the dancer plate has an end portion spaced from a pivot pivotally mounting the dancer plate, the end portion engaging and resting on the supply roll.

20. A feeder assembly for feeding a flexible web of material formed into a supply roll to a processor comprising a housing, a supply roll support on the housing for supporting the supply roll, a feeder drive on the processor for pulling the web from the supply roll, the web being directed by the feeder drive through the processor, a roll drive for moving the supply roll independently of the feeder drive, the supply roll being positioned on the housing to have a first side adjacent to the feeder drive and a second side spaced from the feeder drive, the web passing from the second side and over a top of the supply roll to the feeder drive, the roll drive rotating the supply roll to form a slack web loop extending from the first side of the supply roll downwardly and looping below the supply roll to the second side of the supply roll and over the top of the supply roll to the feeder drive, and a sensor for providing a signal indicating when the slack web loop is extending a selected distance below the supply roll, and providing a signal for controlling the roll drive, the sensor comprising a light source and a plurality of light sensors, the light sensors being spaced from the light source, the slack web loop being formed in a space between the light source and the light sensors, the light sensors being spaced vertically to sense when light is blocked from each light sensor to indicate the distance of a lower side of the slack web loop from a reference position.

21. A feeder assembly for feeding a flexible web of material formed into a supply roll to a processor comprising a housing, a supply roll support on the housing for supporting the supply roll, a feeder drive on the processor for pulling the web from the supply roll, the web being directed by the feeder drive through the processor, a roll drive for moving the supply roll independently of the feeder drive, the supply roll being positioned on the housing to have a first side adjacent to the feeder drive and a second side spaced from the feeder drive, the web passing from the second side and over a top of the supply roll to the feeder drive, the roll drive rotating the supply roll to form a slack web loop extending from the first side of the supply roll downwardly and looping below the supply roll to the second side of the supply roll and over the top of the supply roll to the feeder drive, and a sensor for providing a signal indicating when the slack web loop is extending a selected distance below the supply roll, and providing a signal for controlling the roll drive, wherein the sensor comprises a light source and at least two light sensors spaced from the light source and spaced different distances below the supply roll, the slack web loop being formed in a space between the light source and the light sensor, the light sensors providing a signal when light from the light source is blocked from reaching the respective light sensor by the slack web loop to provide signals indicating different sizes of the slack loop.

* * * * *